US009951538B2

(12) United States Patent
Bowlus et al.

(10) Patent No.: US 9,951,538 B2
(45) Date of Patent: Apr. 24, 2018

(54) MULTI-WALLED SWING PLATE AND SWING BEAM

(71) Applicants: Larry Bowlus, Anchorage, AK (US); Randy Bowlus, Big Lake, AK (US); Heidi Bowlus, Anchorage, AK (US); Connor Bowlus, Anchorage, AK (US); Monika Bowlus, Broomfield, CO (US); Katy Kazell, Broomfield, CO (US); Ambrosia Romig, Anchorage, AK (US)

(72) Inventors: Larry Bowlus, Anchorage, AK (US); Randy Bowlus, Big Lake, AK (US); Heidi Bowlus, Anchorage, AK (US); Connor Bowlus, Anchorage, AK (US); Monika Bowlus, Broomfield, CO (US); Katy Kazell, Broomfield, CO (US); Ambrosia Romig, Anchorage, AK (US)

( * ) Notice: Subject to any disclaimer, the term of this patent is extended or adjusted under 35 U.S.C. 154(b) by 0 days.

(21) Appl. No.: 14/545,490

(22) Filed: May 11, 2015

(65) Prior Publication Data

US 2016/0333576 A1 Nov. 17, 2016

Related U.S. Application Data

(60) Provisional application No. 61/998,255, filed on Jun. 23, 2014.

(51) Int. Cl.
*E04H 9/02* (2006.01)
*E04B 1/98* (2006.01)

(52) U.S. Cl.
CPC ..... *E04H 9/021* (2013.01); *E04B 1/985* (2013.01); *E04H 2009/026* (2013.01)

(58) Field of Classification Search
CPC .... E04H 9/021; E04H 2009/026; E04B 1/985
USPC ..... 52/167.1, 167.4, 167.6, 167.7, 167.8; 384/7, 17, 20, 26, 34, 37, 54, 98
See application file for complete search history.

(56) References Cited

U.S. PATENT DOCUMENTS 4,133,157 A * 1/1979 Bschorr ..... G10K 11/16 188/381
4,823,522 A * 4/1989 White ..... E04H 9/022 14/73.5

(Continued)

*Primary Examiner* — Babajide A Demuren

(57) ABSTRACT

Seismic base isolation and energy dissipation device using a plurality of multi-walled swing plate's that are placed on many central walls that are attached to a base support structure. This arrangement creates a strong load bearing multi-walled swing beam that moves in true pendulum fashion. This system is placed between the structural load and its foundation. This seismic wave base isolation system has the purpose of absorbing seismic wave displacement energy in all directions. This unique design can scale up for very large and heavy loads or scale down to protect sensitive cargo and equipment from destructive motion. The multi-walled swing plates inside the multi-walled swing beam will provide support and absorption of motion by moving as a pendulum and therefore redirecting and dissipating seismic energy. This invention is particularly suited to reduce the initial shock of horizontal ground displacement. This system has a simple design shape and is therefore inexpensive to construct, is easy to engineer and deploy, it requires no uncommon material and requires very little maintenance or advanced electronics.

4 Claims, 7 Drawing Sheets

(56) References Cited

U.S. PATENT DOCUMENTS

| | | | | |
|---|---|---|---|---|
| 2004/0170341 | A1* | 9/2004 | Galkiewicz | A44B 18/0053 384/7 |
| 2013/0042546 | A1* | 2/2013 | Bowlus | E04H 9/021 52/167.4 |

* cited by examiner

MULTI-WALLED SWING PLATE AND SWING BEAM

CROSS-REFERENCE TO RELATED APPLICATIONS

I claim the right of priority from a provisional application 61/998,255 June 2014 Bowlus provisional

REFERENCES CITED

| | | |
|---|---|---|
| 8,464,477 B2 | June 2009 | Bowlus et al |
| 6,725,612 B2 | April 2004 | Kim |
| 6,164,022 A | December 2000 | Ishikawa et al |
| 6,966,154 B1 | November 2005 | Bierwirth |
| 7,472,518 B2 | January 2009 | Chong-Shien Tsai |

BACKGROUND OF THE INVENTION

Technical Field

This invention relates to Seismic base isolation and energy dissipation devices for structures. The present invention will be placed between a structural load and its foundation.

Background Art

Many devices and equipment systems exist to reduce the seismic ground motion energy that is transmitted to a structure when an earthquake event occurs. Many of these earthquake motion protective systems fall in the category of base or foundation isolation systems, as does the present invention. Some of the most complex units are those that reply on pendulum like motion where gravity supplies the force to dampen the energy and restore the supported load to its original point of equilibrium and stability. A common draw back of most prior art of these base isolation systems are they are very expensive and complex. Also these systems require uncommon and difficult to manufacture materials and some require advanced technologies in the fields of electronics, computers and metallurgy. Yet another drawback is many only allow movement in two perpendicular directions. Many of these pendulum systems require constant monitoring and are costly to maintain or need replacement after a seismic event. The engineers designing the older pendulum systems often focus all the seismic energy on to a few pivotal moving parts creating a lot of stress on these complex parts, making it very hard to predict their reliability or extend their application to support larger structures, also limiting the amount of ground movement they could handle. The present invention overcomes many of these drawbacks by introducing a new design that will not focus the seismic motion to a few unique and often over loaded parts. The present invention will scale easily to support large size structural load while remaining the same design or shape, except for using thicker materials and greater dimensions to accommodate larger loads. The present invention will reduce or prevent structural damage and it will eliminate all the previously sited short comings of high cost and mechanical complexity, and limited range of applications also the present invention will be easy to assembly, easy to install and will require very little maintenance.

DESCRIPTION PRIOR ART

A protective system for seismic base isolation and energy dissipation is well known and has many design configurations; most of the prior art of invention for earthquake base isolation systems are very expensive and of complex design. They often require special materials also they are hard to manufacture. Most do not scale up easily and they usually require constant maintenance. Many are difficult to re-engineer or provide options for other applications. Most need to be refurbished or replaced after a quake event and they have limited ground displacement range. Many are very limited in there ability to dissipate seismic energy and most do not have energy damping options. Many do not accommodate all three axis of movement and lastly most focuses all the quake displacement energy in to a few pivotal parts.

1 For example; U.S. Pat. No. 8,464,477 B2 issued June 2009 Bowlus, et al. This system uses a plurality of swing plate's that are placed on a single central wall. The swing plates inside the swing beam will provide support and absorption of motion by moving as a pendulum and therefore redirecting and dissipating seismic energy. This system has a simple design shape and is therefore inexpensive to construct, is easy to engineer and deploy, it requires no uncommon material and requires very little maintenance or advanced electronics. This system is not easy to expand, for example to get the benefit of the swing beam and carry heavier load you have to place many swing beams alongside each other and place the rows on some type of flat support such as a sheet of steel, then they are layered on top of each other three to four layers high, this is cumbersome and expensive.

2 Another example U.S. Pat. No. 6,725,612 B2 issued Apr. 27, 2004 to Kim. This system uses a multi layer assembly of bi-directional rollers placed on a upper and a lower curved guide rail that is set at right angles to each other and are designed to roll in a pendulum like motion. This system is expensive, complex and has many unique specialized parts, also this system not easy to create and will not scale up to handle very large structures, it also will require maintenance, to continue this system is more difficult to engineer. This system will need to be refurbished after quake events also this system cannot handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

3 Another example is U.S. Pat. No. 6,966,154 B1 issued Nov. 22, 2005 to Bierwirth. This system uses an arrangement of Virtual Pendulums called Quake protect modules. The goal is to suspend the entire building structure from long rods allowing the structure to sway gently in an earthquake. The claim is that this system can provide protection even in the maximum possible magnitude of earthquake. This system is expensive, complex and has many unique specialized parts, also this system not easy to create and will not scale up to handle very large structures, it also will require maintenance, to continue this system is more difficult to engineer. This system will need to be refurbished after quake events also this system does claim to handle large ground displacement and dissipate seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

4 Yet another example is U.S. Pat. No. 6,164,022 issued Dec. 12, 2000 to Ishikawa et al. This system uses a threedimensional guiding curved track rail apparatus on the bottom and on the top half, mounted at right angles. The connecting assembly has many parts including roller cylinders. This system is expensive, very complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

5 Another example is U.S. Pat. No. 7,472,518 B2 issued Jan. 6, 2009 to Chong-Shien Tsai This device has a sliding members mounted in two layers in between is two slotted seats with curved in opposites directions and rolling shafts placed at right angles and a dampening layer. This system is expensive, complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

BRIEF SUMMARY OF THE INVENTION

The present invention advances the art of seismic wave base isolation devices for structures by its revolutionary design. It has an increased capacity to dissipate the kinetic energies of ground displacement. The present invention has a simple design and it is easy to understand also very strong and has a wider range of applications due to its increased operational parameters which goes well beyond the present prior art of base isolation systems. The preferred embodiment of this invention is the concept of the multi-walled swing plate. The present invention introduces the multi-walled swing plate element which is fundamentally a rectangular piece of rigid flat plate material with many rectangular slots cut out of the central region allowing it to straddle the many rectangular centralized walls that support this arrangement, it is what creates the self balancing form of a pendulum system that carries the load and easily absorbs and dissipates horizontal displacement earthquake energy. Another preferred embodiment of this invention will leverage the multi-walled swing plate concept to introduce the next advance that uses many swing plates placed in a row and straddling many rectangular central wall supports, thus creating the swing beam. This will be extended in the direction of its swinging movement such that the swing beam could be very long allowing it to stretch across the entire length of a foundation of a structure, if needed. Another preferred embodiment of this invention will leverage the swing beam concept to introduce the next advance that uses multiple swing beams to create a swing beam foundation column. This is a structural arrangement of swing beam layers where more than one complete swing beams is set in a layer, then another layer is placed on top of that layer rotated, usually but not limited to 60 degrees from the next layer of swing beams below it to form a foundation column. This rotating of the next layer of swing beams in the stack is what will allow the swing beam foundation column to react to horizontal ground displacement in all directions. This system can easily be scaled to accommodate the largest of structures, or with smaller dimensions used to transport sensitive cargo such as explosives or electronic equipment while riding on trucks or trains. In this configuration a cargo load can be carried by a swing beam arrangement and these arrangements need to be oriented toward the direction of travel. The present invention includes new design engineering that is very simple, yet strong and has a far wider range of applications and operational parameters with basically the same design and functional understanding. A further object of the present invention is to provide seismic protection that is inexpensive to construct the present invention uses simple construction techniques and easily obtained materials usually but not limited to common plate steel. Another object of the present invention is to provide a protective system that is easy to assemble and requires little or no maintenance. How it operates is, when the ground moves suddenly, as in a horizontal displacement, the multi-walled swing plates will pivot around the fulcrum interface formed at the intersection of the plate and the plate racks which rests on top of the many central wall supports. In the first instant of time the structural load or building mass will try to remain at its original position as described by Newton's first law of motion. In a very short amount of time however the building mass will need to return to a point of equilibrium as a result of gravitational pull. The mass will move along the only path allowed by the swing plates which is a smooth pendulum arc. The return to a balanced point of gravitational equilibrium will not be as fast as the original ground movement that created the imbalance. A fast imbalance, followed by a slow return to balance is the essences of energy absorption or seismic wave motion dissipation and a variety of dampening strategies can be employed. It is doubtful that any other prior art in this field of invention can accommodate the amount of horizontal displacement as this present invention. The present invention incorporates a safe operational design by purposely setting the range of pendulum motion to 30 degrees off center, this will become clearer when the drawing are viewed. Another object of the present invention is to make its application and subsequent deployment easy to understand, easy to calculate and to engineer. A simple and direct relationship exists when designing the appropriate multi-walled swing plate and multi-walled swing beam. You increase the height of swing plate to increase the allowable horizontal displacement that a structure can move without being damaged. The close approximation is 60 degrees of motion, 30 degrees off center in both directions, in a true pendulum arrangement this approximately the length of the radius or in this case the length of the leg of the multi-walled swing plate. Using this present system to provide protection will mean that the structural engineer can easily redesign the size of the multi-walled swing plate and multi-walled swing beam to match the predicted ground movement. The minimum allowable horizontal displacement is usually sited by local area building codes. The present invention advances the art of seismic wave motion base isolation by the introduction of the multi-walled swing plate and by its deployment inside the multi-walled swing beam device. Another object of the present invention is to provide a protective system that is capable of dealing with a vertical displacement by using a sliding wall held securely by two stationary walls on each side of it, this pattern is copied many times to add strength.

BRIEF DESCRIPTION OF THE DRAWINGS

For a full appreciation of the objects of this invention to be clearly understood and the advancement in the art of the field of this invention be made obvious we will fully describe them in the following drawings.

DETAILED DESCRIPTION OF THE INVENTION

Figure 1:
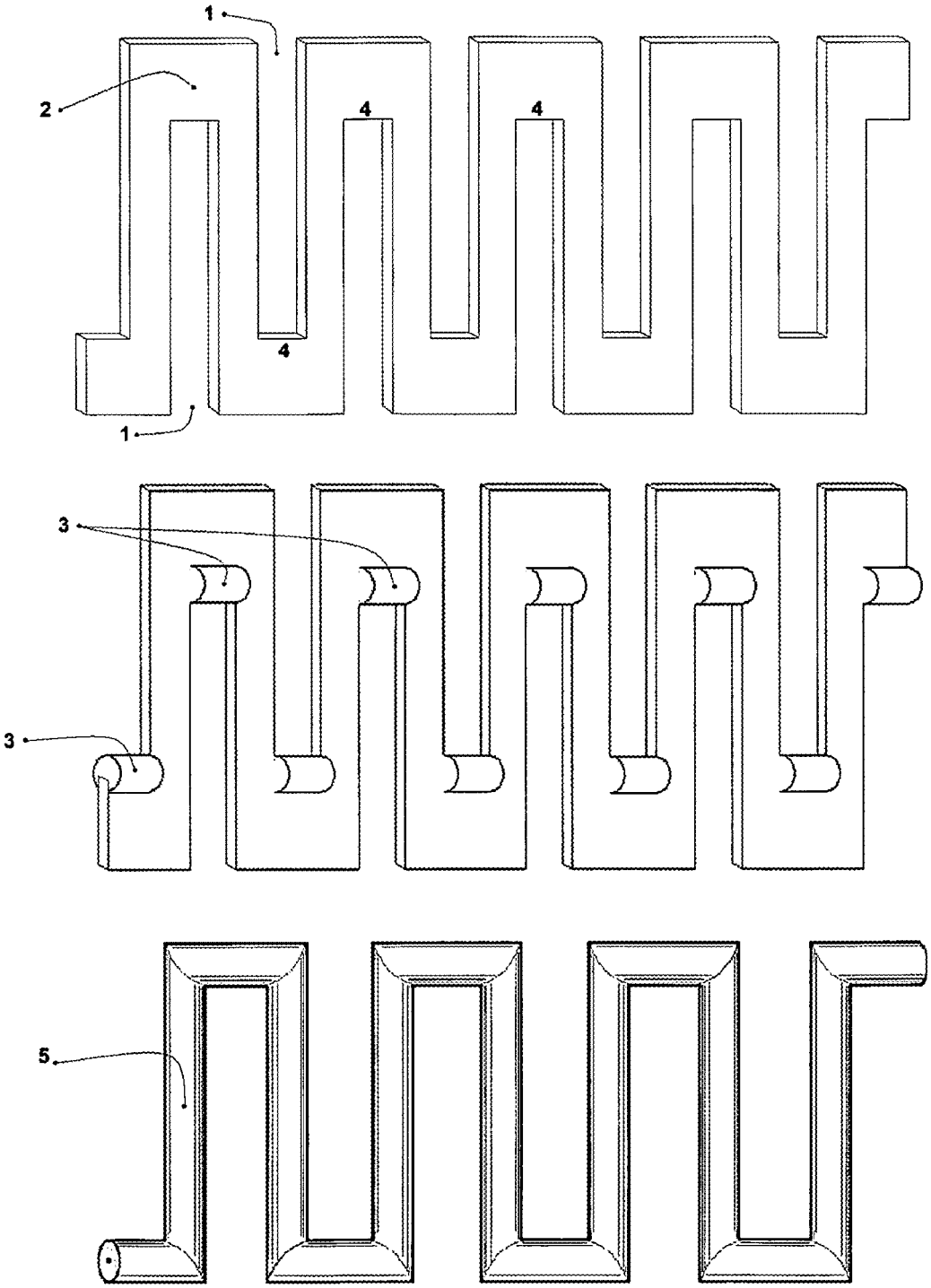
FIG. 1 shows the basic multi-walled swing plate with multi support wall slots in three standard forms, flat plate and flat plate with short axle sections joined to the top of the slots and the rod only type.
Figure 2:
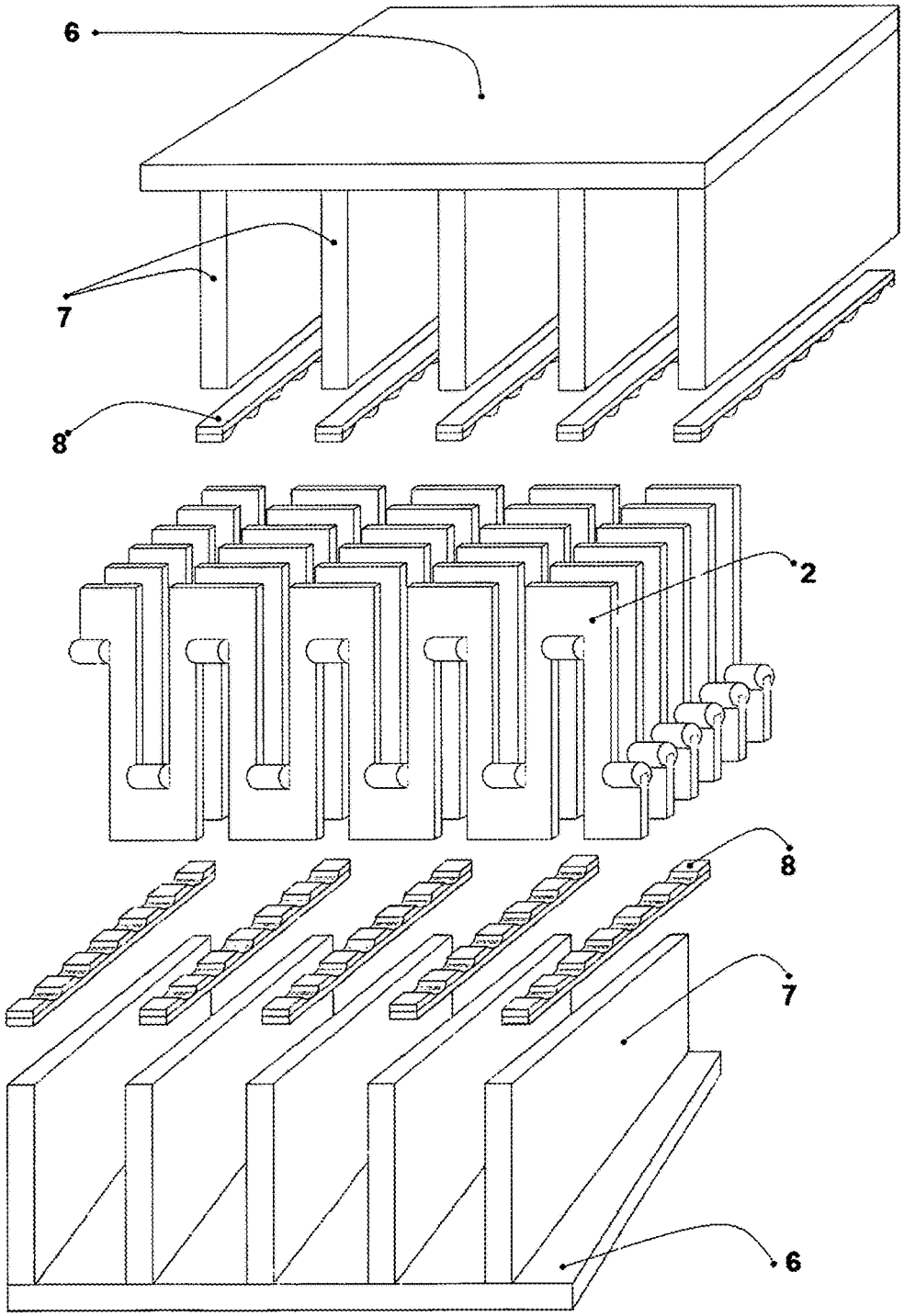
FIG. 2 shows the basic multi-walled swing beam in a disassembled view.
Figure 3:
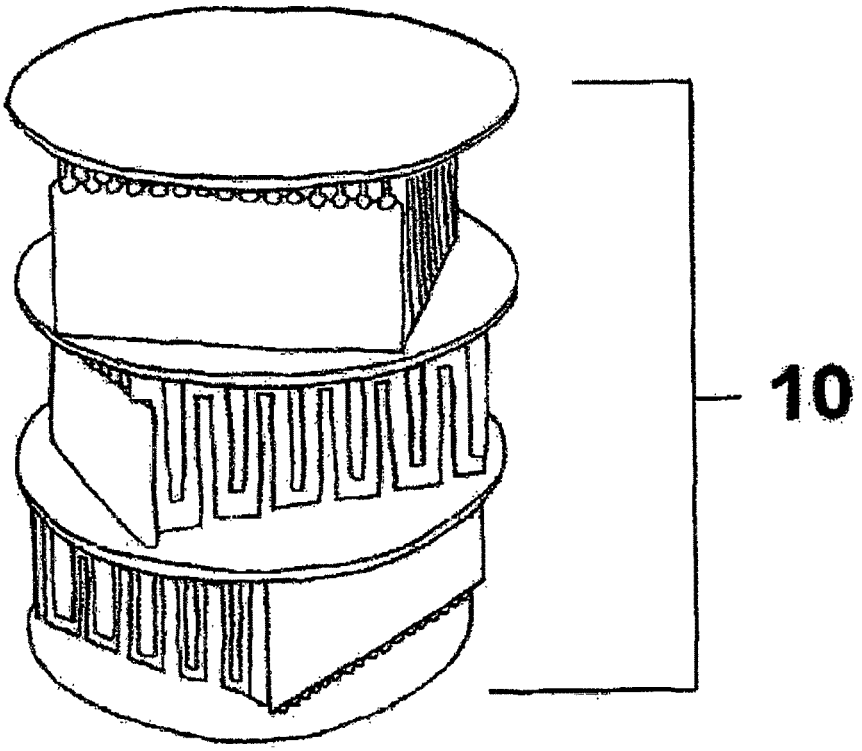
FIG. 3 shows the basic multi-walled swing column consisting of three layers rotated at 60 degrees
Figure 4:
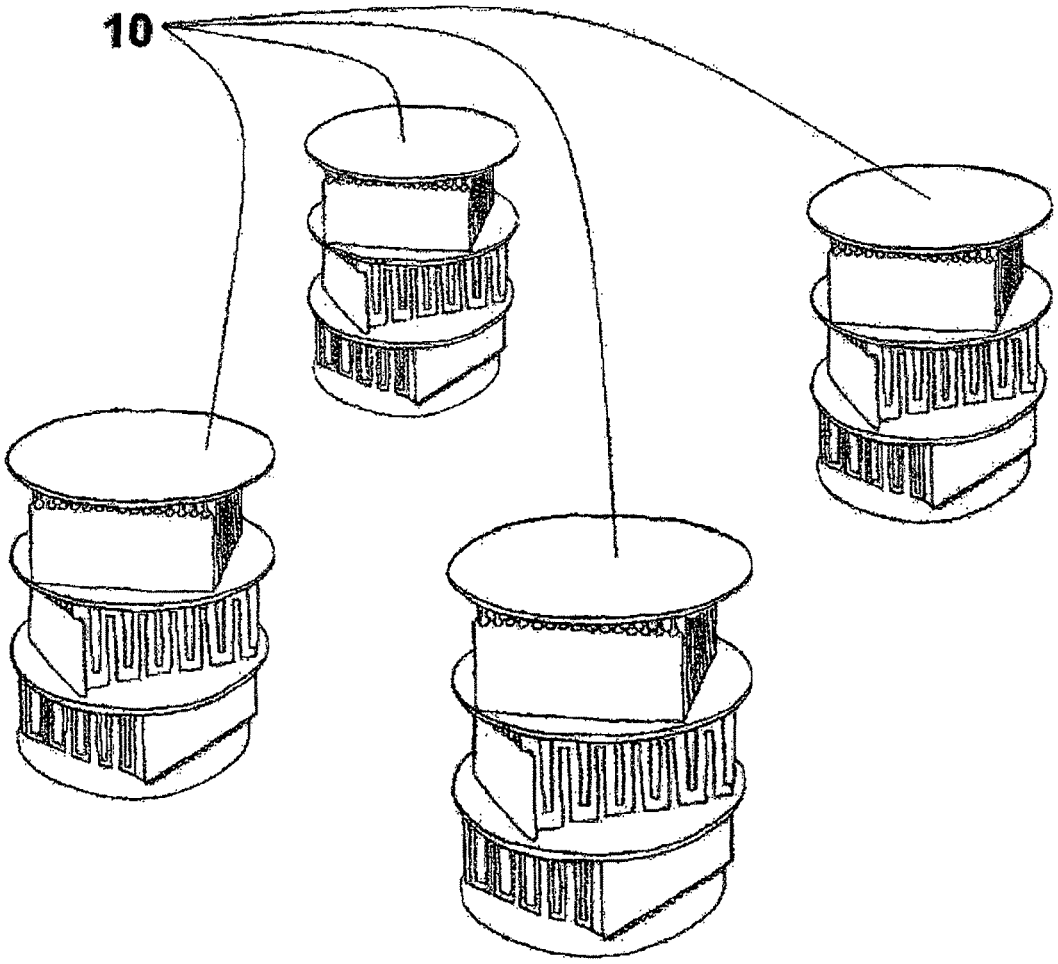
FIG. 4 shows the minimum of four columns needed to support a structure.
Figure 5:
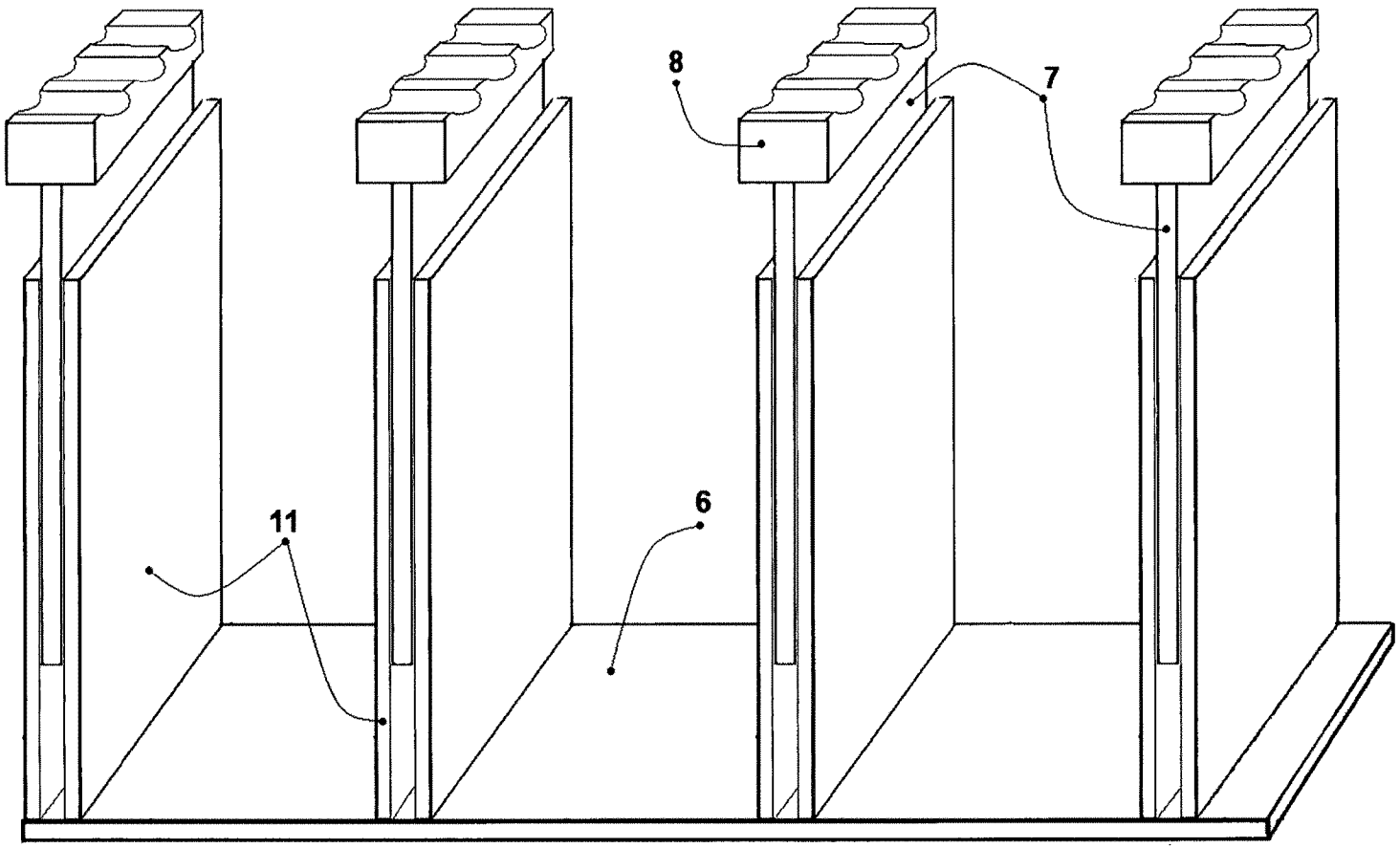
FIG. 5 shows a view of the new vertical wave unit with sliding walls.
Figure 6:
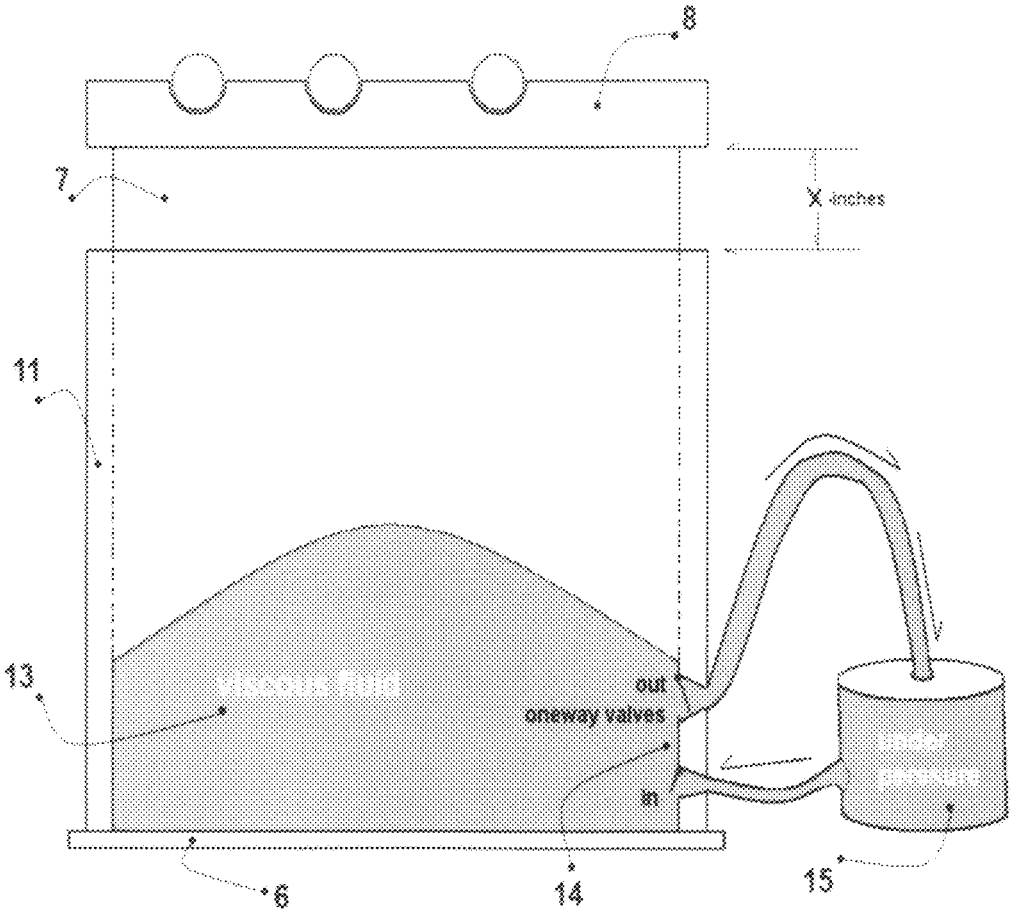
FIG. 6 shows a view of the new vertical wave unit with fluid hydraulic dampening.
Figure 7:
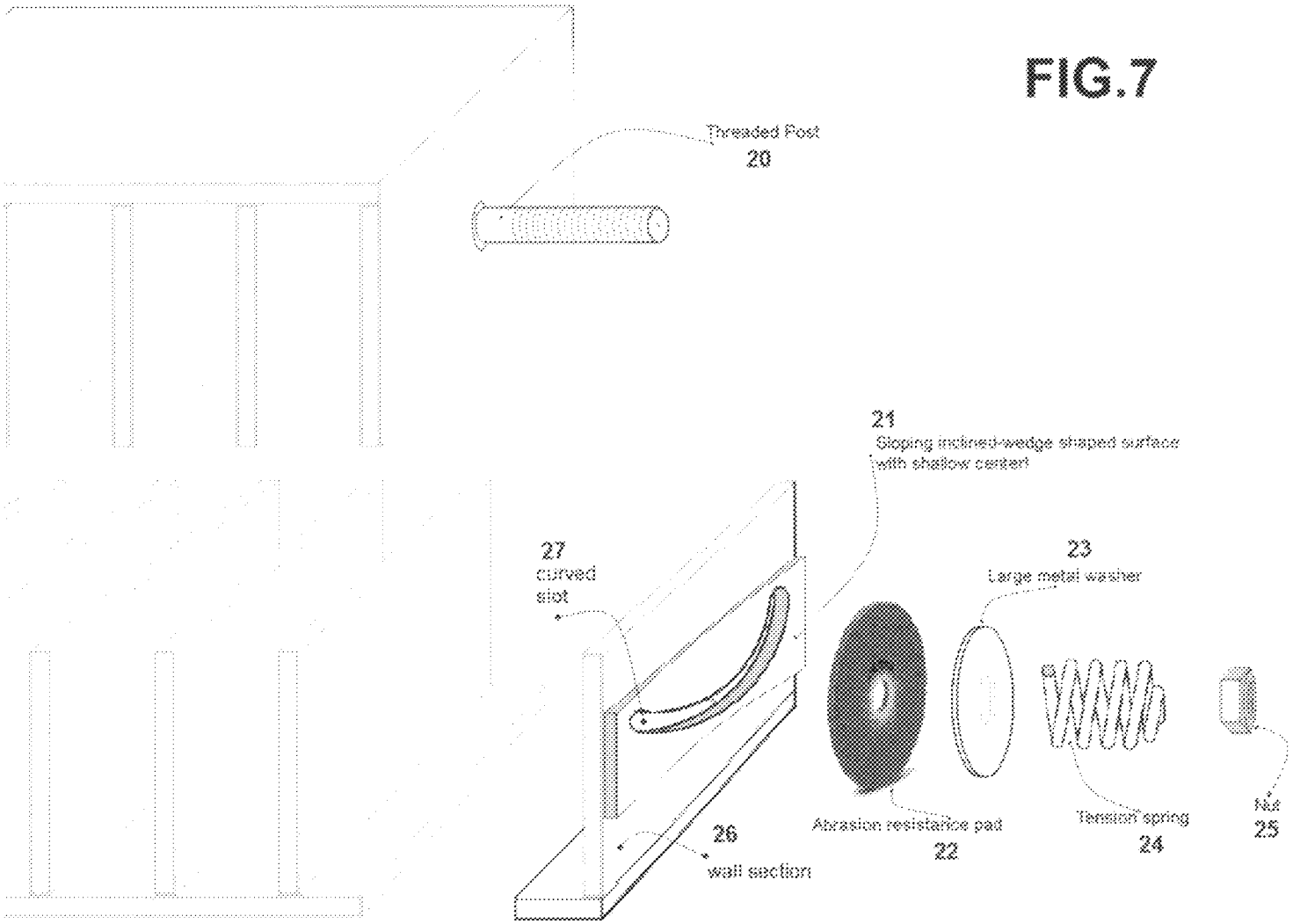
FIG. 7 shows an exploded view of a complete mechanical dampening unit that uses spring pressure to impede sliding motion.

The preferred embodiment of this invention relates to a seismic wave motion isolation device for base or foundation structures and the transport of sensitive equipment. This device or apparatus will protect structures from the destructive effects of seismic wave motion in both the horizontal and vertical planes. The objects of invention are the multi-walled swing plate and the multi-walled swing beam device and a vertical unit. This seismic wave motion isolation device can be configured and built to protect the largest structures by scaling the dimensions and load capacities without altering the basic design. The dimensions are changed simply by altering length, width and height of the apparatus while the load capacities are mostly changed by increasing the size and thickness of the plate material used and the number of multi-walled swing plates used. This seismic wave motion isolation device can be configured and built to protect the most sensitive of machinery, cargo or explosives transported via a truck or train. This seismic wave motion isolation device is uncomplicated in design and requires little maintenance. This seismic wave motion isolation device requires no electronics and monitoring. This seismic wave motion isolation apparatus is made from inexpensive and common materials. This seismic wave motion isolation device makes use of pendulum motion to gently redirect horizontal ground displacements set in motion by earthquake events. When the ground moves suddenly, as in a horizontal displacement, the multi-walled swing plates will pivot around the fulcrum interface formed at the intersection of the swing plate and the plate rack which rests on top of the central wall support. In the first instant of time, the structural load or building mass will try to remain at its original position as described by Newton's first law of motion. In a very short amount of time after the event, the building mass will need to return to a point of equilibrium as a result of gravitational forces. The mass will move along the path allowed by the swing plates which is a smooth pendulum arc. The return to a balanced point of gravitational equilibrium will not be as fast as the original ground movement that created the imbalance. A fast imbalance followed by a slow return to balance, is the essences of energy absorption or seismic wave motion dissipation. The following drawings are presented to more fully explain this invention and the new engineering designs which represent an advance in the art and are considered part of the specifications:

As is illustrated in FIG. 1, this clearly shows the basic multi-walled swing plate design 2 a preferred embodiment of this invention, 4 shows the flat upper edge of the slots 1 known as the fulcrum interface that the swing plate will pivot on, 3 shows the upper edge of the slot covered by a slotted round rod called an axle unit, The number of slots can be extended as the need for increased strength and dampening is required. The swing plate is made of a ridged material usually but not limited to steel or metal, its general shape is rectangular with many smaller rectangular slots cut in the center area to receive many wall supports, for smaller systems the use of strong plastics will be adequate also plastics can be utilized where sparks could be hazardous and need to be suppressed like in a explosion proof environment. 5 show's a full steel rod model. FIG. 2 clearly shows, in a elevated exploded view, a standard multi-walled swing beam, 6 show the flat square base plate, 7 shows the many walls, 8 shows the many plate racks and 2 shows a multi-walled swing plate with the axle units. The multi-walled base has to match the multi-walled swing plates it will carry. This structure is made of a ridged material usually but not limited to steel or metal, for smaller systems the use of strong plastics will be adequate also plastics can be utilized in an explosion proof environment. Another preferred embodiment of this invention is, there are many strategies for dampening the motion by impeding the movement of this system such as but not limited to a viscous liquid. Other dampening strategies are mechanized using pressure springs systems, gears or weighted pulley systems. FIG. 3 clearly shows a standard multi-walled beam support column 10, consisting of three levels of swing beams staked on top of each other and rotated 60 degrees. FIG. 4 clearly shows in an elevated orthogonal view, four swing columns 10 the minimum number needed to support a typical load they are positioned in this view in each corner, FIG. 5 clearly displays a lower unit of our new Vertical swing beam unit, 11 clearly shows the double stationary walls used to allow the main wall 7 to slide, This structure is made of a ridged material usually but not limited to steel or metal, for smaller systems the use of strong plastics will be adequate also plastics can be utilized where sparks are dangerous and need to be suppressed such as in an explosion proof environment. FIG. 6 clearly shows in a cut away side view a new Vertical swing beam unit that uses hydraulic fluid 13 to absorb and cushion the downward motion of the sliding wall. This arrangement will allow the wall 7 to extend upward easily during a quick vertical displacement but return downward slowly by comparison. This fluid exchange and action is accomplished by the use of one way hydraulic values 14, the fluid is held in a pressurized container 15. This hydraulic process is responsible for the absorption and dissipation of vertical displacement energy. This structure is made of a ridged material usually but not limited to steel or metal, for smaller systems the use of strong plastics will be adequate also plastics can be utilized where sparks are dangerous and need to be suppressed such as in an explosion proof environment. FIG. 7 clearly shows in an elevated orthogonal view, a pressure spring damping unit another preferred embodiment of this invention. 20 is a threaded post affixed to the outside wall of the standard swing beam, 26 is a short wall section and in the center of that wall is curved slot 27, additionally a concaved wedge shaped rectangle sheet of metal that also has a identical curved slot cut into it, the curves will match up together so that the threaded post can pass threw, sliding over the post will be a abrasive pad 22, next to slide over the post will be a large washer 23, next will be a strong spring 24 and a large nut 25.

In view of the above, it has been shown that the many advantages of the present invention of a seismic wave motion isolation device for base or foundation structures have been achieved. As various changes could be made in the above examples of construction without departing from the scope of the invention, it is intended that all of the above descriptions of the preferred embodiments of this invention or shown in the accompanying drawings shall be interpreted as illustrative and not in a limiting sense. Accordingly, the drawings and description presented for this invention are intended to embrace all alternatives, modifications, and variations that fall within the spirit and scope of the of preferred embodiments.

What is claimed:

1. A seismic base isolation and energy dissipation apparatus comprising:

a multi-walled swing beam comprising;

a first set of plurality of walls spaced parallel to each other, mounted upright and directly connected to a top surface of a flat square base plate, such that the base plate is underlying the plurality of walls, each wall having a top surface;

a first set of plurality of plate rack, wherein each plate rack comprises an elongate square beam having a plurality of notches on the top surface of said elongate square beam; each plate rack disposed directly on the top surface of each walls such that the notches are accessible;

a second set of plurality of walls spaced parallel to each other, mounted upright and directly connected upright onto a bottom surface of a flat square base plate, such that the base plate is overlying the plurality of walls, each wall having a bottom surface;

a second set of plurality of plate rack, wherein each plate rack comprises an elongate square beam having a plurality of notches on the bottom surface of said elongate square beam; each plate rack disposed directly on the bottom surface of each walls such that the notches are accessible;

a substantially flat plate in the form of a square wave shape, the substantially flat plate comprising alternating elongate slots sized for accommodating the first and second sets of upright walls, each alternating slot having an upper or lower edge with a round rod; wherein the square wave shaped substantially flat plate in deposited between the first and second set of plurality walls so that the round rods of the slot are positioned in the respective notches of both the first and second plate rack to define a fulcrum interface.

2. A seismic base isolation and energy dissipation apparatus according to claim 1, further comprising a swing beam foundation column comprising a plurality of swing beams layered and stacked onto one another, an intermediate layer disposed between a topmost and a bottom most layer, said intermediate layer offset 60 degree in relation to both the topmost layer and the bottom most layer.

3. A seismic base isolation and energy dissipation apparatus according to claim 1, further comprising a swing beam vertical-wave unit comprising a plurality of swing beam base unit with double walls, a plurality of single walls each disposed to slide freely between each double walls, a plurality of plate racks fixed to the plurality of single walls, a reservoir of viscous fluid sealed between the double walls and disposed beneath the single wall, wherein a one-way value allow the fluid to flow in & out to a pressurized container creating a hydraulic ram to absorb vertically motion of the single walls through fluid displacement.

4. A seismic base isolation and energy dissipation apparatus according to claim 1, further comprising a swing beam motion damping unit attachment comprising a threaded bolt (20) affixed to the outermost wall of the second set of plurality of walls (7) of the swing beam, a wall section (26) fixed to a narrow base of flat plate disposed to be aligned with the base plate (6) underlying the first set of plurality of walls, a curved slot formed on the wall section (26) configured to accommodate the bolt and facilitate motion of the bolt along the slot, a sloping inclined-wedged surface plate (21) with a curved slot such that the slot aligns with the slot of the wall section (26), an abrasive pad (22) positioned on the bolt (20), a metal washer (23) positioned on the abrasive pad (22) and the bolt (20), a tension spring (24) positioned on the metal washer (23), the abrasive pad (22) and the bolt (20), and a nut is screwed on the threaded end of the bolt with the tension spring (24), the metal washer (23), and the abrasive pad (22) held in between.

* * * * *